US008893458B2

(12) United States Patent
Lawson et al.

(10) Patent No.: US 8,893,458 B2
(45) Date of Patent: Nov. 25, 2014

(54) METHOD AND APPARATUS FOR PACKAGING WIRE FENCE CLIPS

(75) Inventors: Timothy R. Lawson, Sand Springs, OK (US); Billy Ray Lawson, Tulsa, OK (US); Thomas M. Askew, legal representative, Tulsa, OK (US)

(73) Assignee: Blue Sky Manufacturing, LLC, Reno, NV (US)

( * ) Notice: Subject to any disclaimer, the term of this patent is extended or adjusted under 35 U.S.C. 154(b) by 529 days.

(21) Appl. No.: 13/161,420

(22) Filed: Jun. 15, 2011

(65) Prior Publication Data

US 2012/0067007 A1 Mar. 22, 2012

Related U.S. Application Data

(60) Provisional application No. 61/355,472, filed on Jun. 16, 2010.

(51) Int. Cl.

| | |
|---|---|
| ***B65B 35/30*** | (2006.01) |
| ***B65B 15/04*** | (2006.01) |
| *B65B 9/02* | (2006.01) |

(52) U.S. Cl.

CPC .. *B65B 15/04* (2013.01); *B65B 9/02* (2013.01)

USPC ..... 53/443; 53/147; 53/399

(58) Field of Classification Search

USPC ..... 53/399, 582, 591, 443, 147

See application file for complete search history.

(56) References Cited

U.S. PATENT DOCUMENTS

| | | | | |
|---|---|---|---|---|
| 3,472,366 | A * | 10/1969 | Ackerman | 206/344 |
| 3,736,198 | A * | 5/1973 | Leistner | 156/65 |
| 4,415,765 | A * | 11/1983 | Iwasa et al. | 174/72 A |
| 5,609,712 | A * | 3/1997 | Takumi | 156/298 |
| 6,722,404 | B2 * | 4/2004 | Osborne | 141/133 |
| 6,915,619 | B2 * | 7/2005 | Baldwin | 53/399 |
| 8,650,740 | B2 * | 2/2014 | Heskel et al. | 29/458 |

* cited by examiner

*Primary Examiner* — Hemant M Desai

(74) *Attorney, Agent, or Firm* — J.A. McKinney & Assoc., LLC

(57) ABSTRACT

An apparatus and method for packaging wire fence clips first collects and aligns fence clips into a series of batches that each incorporate a selected quantity of clips. Each batch of clips is fed through a packaging station where first and second flexible adhesive substrates are affixed to opposite sides of the batch, and successive batches are separated to form compact and easy to carry bundles of the selected quantity of clips. A label applicator supplies adhesive labels to one of the flexible substrates.

7 Claims, 8 Drawing Sheets

METHOD AND APPARATUS FOR PACKAGING WIRE FENCE CLIPS

The present application claims the benefit of U.S. Provisional Application No. 61/355,472, filed 16 Jun. 2010, and entitled "Method and Apparatus for Economically Packaging Wire Fence Clips Into Compact, Safe, Easy to Handle Bundles", the disclosure of which is hereby incorporated herein by reference.

BACKGROUND OF THE INVENTION

1. Field of the Invention

The present invention relates to manufactured wire products such as wire clips for installing wire fence such as barbed wire fence onto T-posts and the like, and more particularly to a method and apparatus for economically packaging such wire fence clips or the like into compact, safe, easy to handle bundles. Still more particularly, the invention relates to such a method and apparatus that incorporates a labeling mechanism for identifying packages so produced.

2. Discussion of the Prior Art

Barbed wire fence and other wire fence types are often used in agricultural and rural settings such as range land because the fences can be erected quickly and maintained economically. Barbed wire fencing has a rich history which is often described with reference to patents covering improved styles of barbed wire and the machines used to make that wire. For example, the Glidden patent (November 1874, U.S. Pat. No. 157,824) was widely considered to cover the dominant wire fence and an apparatus for twisting the fence strands.

Barbed wire or other wire fence strands are often strung along a row of steel fence posts called "T-Posts", wherein each post has a T-shaped cross-section for strength and stability and incorporates a series of slots formed by outwardly projecting tabs along its length for receiving and supporting the fencing wire. The T-Post is vertically positioned to support intersecting substantially horizontal strands of barbed wire or other fencing, and the fencing is held in place by the application of wire clips. As is well known, the wire clips are configured with a first end bent at an acute angle downwardly, with second and third intermediate bends defining a V-shaped segment inclined downwardly and a fourth bend terminating in an upwardly projecting free second end. This configuration permits a fence installer to place the first end of the clip over a wire fence strand that is supported on a T-Post on one side of the post and then manipulate the clip so that the V-shaped segment passes around the T-Post and the second free end engages the horizontal fence strand on the opposite side of the post to thereby secure the strand in place Such prior art T-post clips often are used in large quantities when building fences surrounding large parcels of land, so typically they have been packaged in large bags that may hold, for example, 1,000 clips. Since these clips are manufactured with a convoluted shape, they do not lie flat when stored, for the first free end projects downwardly while the second free end projects upwardly from the intermediate V-shaped portion, and that makes them not only difficult to package conveniently but because the manufacturing process often produces sharp ends, they are hazardous to handle. When packaged in a bag, the clips become tangled together in bunches that have many sharply protruding free ends. The user is often forced to either dump the tangled clips out to separate them or reach into the bag where the free ends may injure the fingers or hands. Picking up one clip often results in ten or twenty additional clips being picked up at the same time, and separating them is time consuming and frustrating.

Furthermore, T-Post fencing is often used today for enclosing small areas, where only small quantities of clips are required, so the conventional 1,000-count bag may often be inconvenient and an unnecessary expense for the fence installer. In addition, in present-day product marketing, the use of bar codes and similar identifying labels is desirable, if not a necessity, and such is the case for such fencing clips.

There is a need, therefore, for a convenient, flexible, inexpensive and unobtrusive system and method for economically packaging wire fence clips into compact, safe, easy to handle bundles, and for placing on such packages suitable labels or indicia such as bar codes.

OBJECTS AND SUMMARY OF THE INVENTION

In accordance with the present invention, a convenient, flexible, economical apparatus and method for packaging wire fence clips in compact, safe, easy to handle bundles of, for example, 20 clips, first collects and aligns fence clips into a series of batches that each incorporate a selected quantity of clips. Each batch of clips is fed through a packaging, or taping, station where first and second flexible adhesive substrates are affixed to opposite, upper and lower sides of the batch, and successive taped batches exiting from the taping station are separated to form compact and easy to carry bundles of the selected quantity of clips. Each bundle is safe to carry and use, due to the fact that the first and second ends of each clip are aligned and not randomly projecting outwardly in a dangerous tangle, and the bundles are convenient to handle and use since they include a convenient number of fence clips for easy use in the field, and taped bundles do not get tangled, even when a large quantity of bundles are stored in a box or bag.

Briefly, in accordance with the invention typical wire T-Post fence clips are formed by a conventional wire forming machine from a wire segment to incorporate a first free end and an opposite, second free end, with four bends therebetween which define a substantially planar V-shaped central, or body, segment for engaging a T-Post and angled end sections for engaging a wire strand that is to be secured to a post. Each clip typically is about two inches wide and about one and one-half inches deep. After each clip is formed, it is placed on an alignment track, or rail, for example between upper and lower parallel spaced planar rail segments, with other clips in a continuously running process. The successive clips are oriented so that their central body portions, or segments, are parallel, and they are slidably inserted between the upper and lower segments of the rail, with their free ends projecting laterally away from the rail on opposite sides of the rail.

As the process continues and the clips advance, they slide down the rail along an alignment track path to a stop pin, which interrupts the flow and where the clips are collected into a group, or batch, of a selected quantity (e.g., 19, 20, 50, etc.). Once the selected quantity of clips has collected at the stop pin, a release mechanism such as a solenoid actuates the pin to withdraw it to let the clips slide down the path to a taping station, where upper and lower strips of a flexible adhesive-bearing substrate, which are supplied from upper and lower supply rolls, respectively, are rolled onto the flat, V-shaped central, or middle, body portion of the clips to form taped bundles of clips. A gap is formed in the tape between each successive bundle of clips and they are separated at the gap as they exit from the taping station. The adhesive substrate may be 1½ inch wide masking tape, or the like, and for convenience, may be hereinafter referred to as bundle adhesive tape, or simply masking tape.

The strips of masking tape from the rolls of adhesive substrate travel along corresponding upper and lower paths and over corresponding tension rollers before being applied to the upper and lower surfaces of a batch of clips at a nip between a pair of pressure rollers. One of the pressure rollers is driven by a DC motor, while the other is an idler that is driven by the pressure at the nip where they engage the opposite, upper and lower surfaces of the central body portion of the batches of clips. The speed of the pressure rollers, and thus of the tape strips that are drawn around these rollers into the nip, is controlled by a DC motor speed control to synchronize the tape speed and the rate at which bundles are formed, to the speed of the clip-making machine. Tension rollers adjacent the paths of the upper and lower strips of masking tape maintain a constant tension on the tape to help position it in the middle of the clips. A micro switch attached to a cam on the clip manufacturing machine counts every revolution of the cam, which equates to one clip, to keep track of the number of clips formed and supplied to an accumulating batch, and to actuate the stop pin when the desired number of clips has been accumulated to feed the batch between the upper and lower strips of tape at the nip between the pressure rollers.

As a safety feature, an automatic shutoff sensor is attached to the inclined rail above the stop pin to detect whether a clip passes by the automatic shutoff within a preset time of two seconds; if not, it shuts off the machine. Therefore, if the wire forming machine makes a bad clip and that clip does not slide down the inclined rail, the automatic shutoff will stop the machine, keeping it from continuing to make bad clips and jamming.

In order to affix labels incorporating bar codes or other indicia to the clip bundles as they are being formed at the taping station, a label applicator assembly, or mechanism, is provided adjacent one masking tape path between its supply roll and the taping station. This label applicator assembly includes a supply of label tape, which consists of a roll of a thin, flexible substrate having labels adhesively, but releasably, affixed to one surface of the substrate. The label tape is drawn under tension sharply around a release post adjacent the path of either the upper or the lower masking tape strips prior to the taping station. The label tape passes around the release post at an acute angle of, for example, about 15 degrees, causing an adhesive label to be released from its surface and since this occurs adjacent the path of the masking tape, the leading edge of the label engages and adheres to the masking tape. The label is drawn off the label tape by the masking tape as they pass the release post in opposite directions, and thus is transferred to the surface of the masking tape. As a result, when the masking tape is applied to a batch of clips at the taping station, the tape will include a label, so that the clip bundle will incorporate a label carrying the desired bar code or other indicia.

Persons having skill in the art will appreciate that the system and method of the present invention economically packages aligned wire fence clips into a compact, safe, easy to handle bundle of a selected quantity by attaching labels to the surface of a bundle-forming tape strip and then affixing first and second flexible adhesive strips such as upper and lower masking tape segments onto the collected, aligned clips. The product of this process is a compact and easy to carry bundle of a selected quantity of clips. Each bundle is safe to carry and use, due to the fact that the first and second free ends of each clip are aligned and with adjacent clip ends and therefore not individually projecting outwardly in such a way as to cause a dangerous tangle which is likely to injure a user or fence installer. Furthermore, the bundles will carry suitable indicia for identification.

BRIEF DESCRIPTION OF THE DRAWINGS

The above and still further features and advantages of the present invention will become apparent upon consideration of the following detailed description of a specific embodiment thereof, particularly when taken in conjunction with the accompanying drawings, wherein like reference numerals in the various figures are utilized to designate like components, in which.

DESCRIPTION OF PREFERRED EMBODIMENTS

Figure 3:
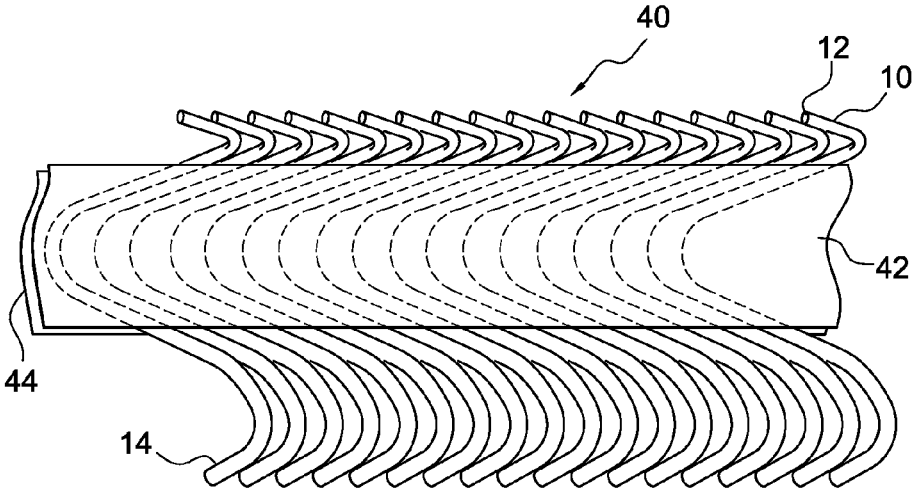
FIG. 3 illustrates a selected quantity of the wire clips of FIG. 1, secured by first and second flexible adhesive strips to provide a collected, aligned bundle of clips, in accordance with the present invention.
Figure 1:
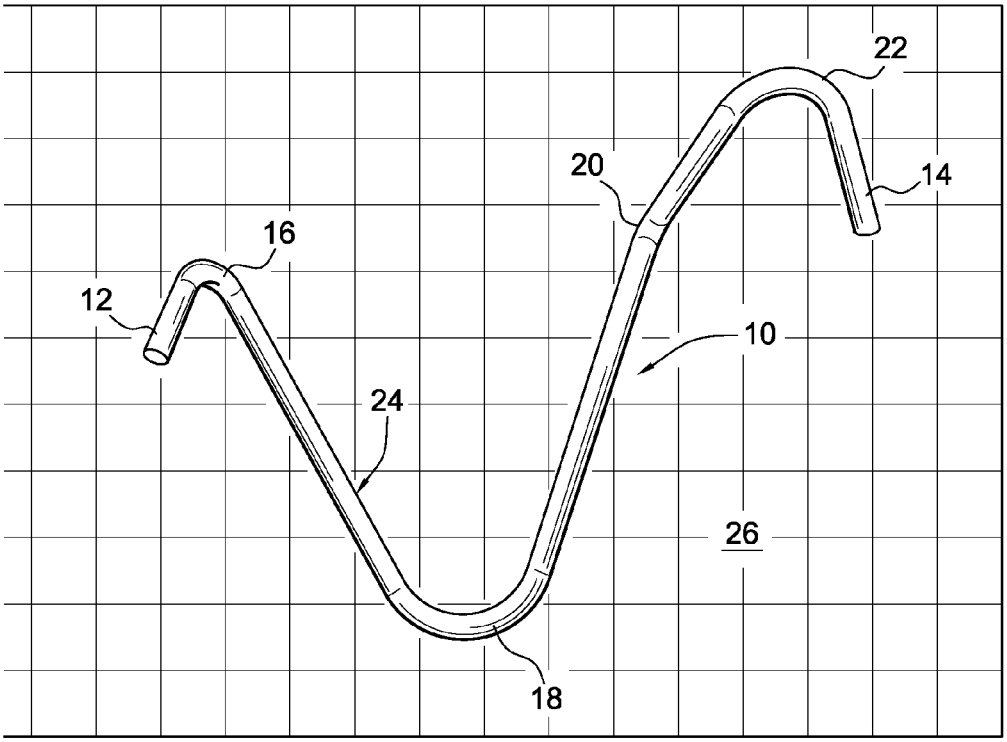
FIG. 1 (Prior Art)
FIG. 1 illustrates a single known wire T-Post fence clip on a background ruled in quarter inch lines, the clip having a planar central body segment lying flat on the ruled surface, and first and second free ends projecting away from the plane of the central body segment.

Turning now to a more detailed description of the invention, as illustrated in FIGS. 1-11, T-Post clips 10 manufactured in accordance with the prior art are formed from a single length of wire having a first free end 12 opposite a second free end 14, with four acute bends forming angles at 16, 18, 20 and 22 along the length of the clip 10 between the first and second ends. As illustrated, a central body portion 24 of the T-Post clip 10 lies on a plane 26 and is configured with the first end 12 bent upwardly from the plane at an acute angle at bend 16, as seen on the left side of FIG. 1. The second bend 18 in the body portion forms a generally V-shaped angle to define a substantially planar V-shaped central segment between bends 16 and 20 that, in one embodiment, is about two inches wide and about one and one half inches deep. The third angle at bend 20 is bent upwardly and outwardly toward the second end 14 of the clip, and the fourth angle at bend 22 folds the second free end 14 of the clip downwardly toward the plane 26, the fourth bend defining a downwardly-opening V-shaped segment proximate the second end. Thus, the first and second ends of the clip extend out of the plane of the central body portion 24. The T-Post clip 10 as here described may hereinafter be referred to as a wire fencing clip, or simply a clip.

Figure 2:
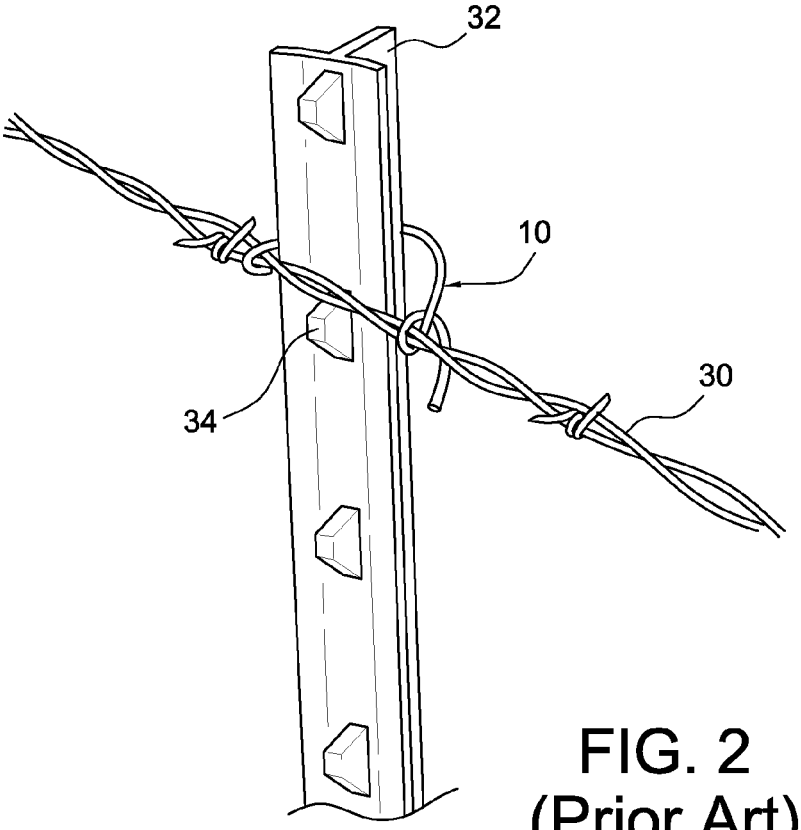
FIG. 2 (Prior Art)
FIG. 2 illustrates the wire fence clip of FIG. 1 securing a length of fencing to a conventional T-Post fence support.
Figure 10:
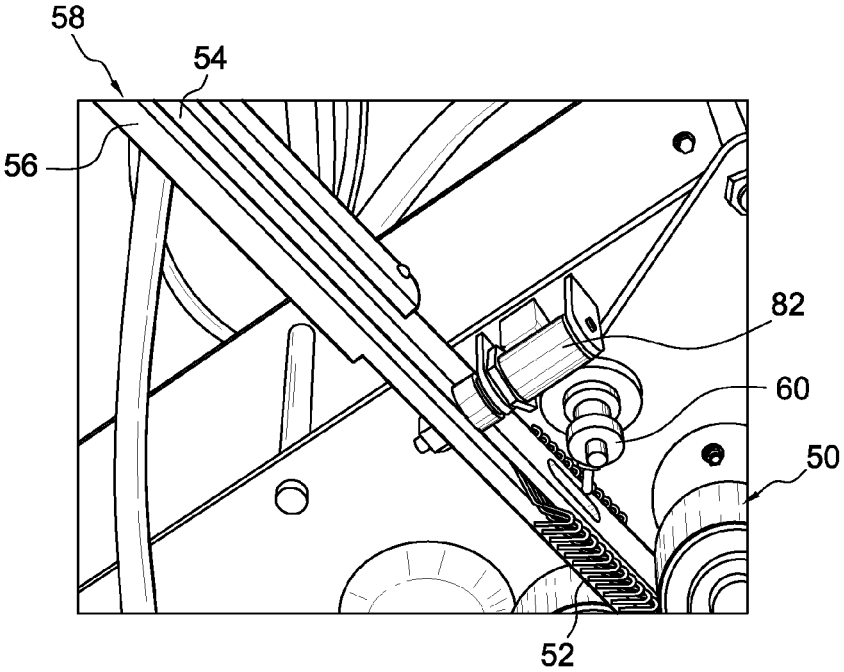
FIG. 10 illustrates a clip counter for the apparatus of FIG. 6.

As is known, and illustrated in FIG. 2, the foregoing fence clip configuration permits a fence installer to place the T-Post clip 10 upon a fence strand 30, such as a barbed wire fence strand, that is to be secured to a conventional T-Post 32 having a series of upstanding tabs 34 along its length. As illustrated, the strand 30 is positioned and supported on a tab 34, and the clip 10 is manipulated so that the first end 12 of the clip is positioned on the strand on one side of the T-Post, the central body portion 24 extends around the T-Post on the side opposite to the location of the strand 30, and the second end of the clip is secured to the strand on the other side of the T-Post, with the V-shaped angle at bend 22 engaging the fence strand 30.

Often, several wire strands are secured along the length of each T-Post, with each strand being secured by a clip 10, so that the total number of clips used in a fence installation will depend on the length of the fence, the number of strands to be attached to each T-Post, and the number of T-Posts needed to support it. As discussed above, and in accordance with the invention, the clips are conveniently packaged in bundles of, for example 20, 25, 50, etc. clips, the number in a bundle being determined by, for example, marketing considerations. An example of such a bundle is illustrated at 40 in FIG. 3, where 19 clips are shown as being secured in close side-by side alignment by upper and lower strips 42 and 44 of an adhesive-bearing substrate such as conventional masking tape or its equivalent. The clips 10 are aligned so that the central portions 24 of the clips are secured by the masking tape and the first and second free ends 12 and 14 of each clip are aligned with adjacent clip ends and therefore not individually projecting outwardly in various directions to produce random sharp ends that would be likely to injure a fence installer or other individual handling the bundles. Furthermore, the formation of bundles allows a large number of bundled clips to be packaged in a box or bag without the likelihood of producing the inconvenient, if not dangerous tangles which are a common problem with prior packaging of fencing clips.

Figure 5:
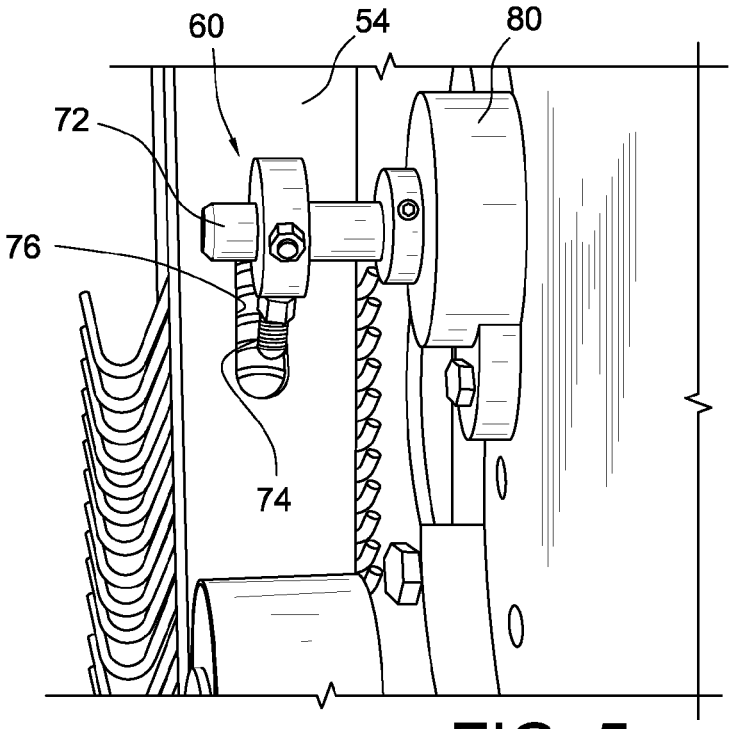
FIG. 5 is an enlarged view of a clip stop utilized in the apparatus of FIG. 4.
Figure 4:
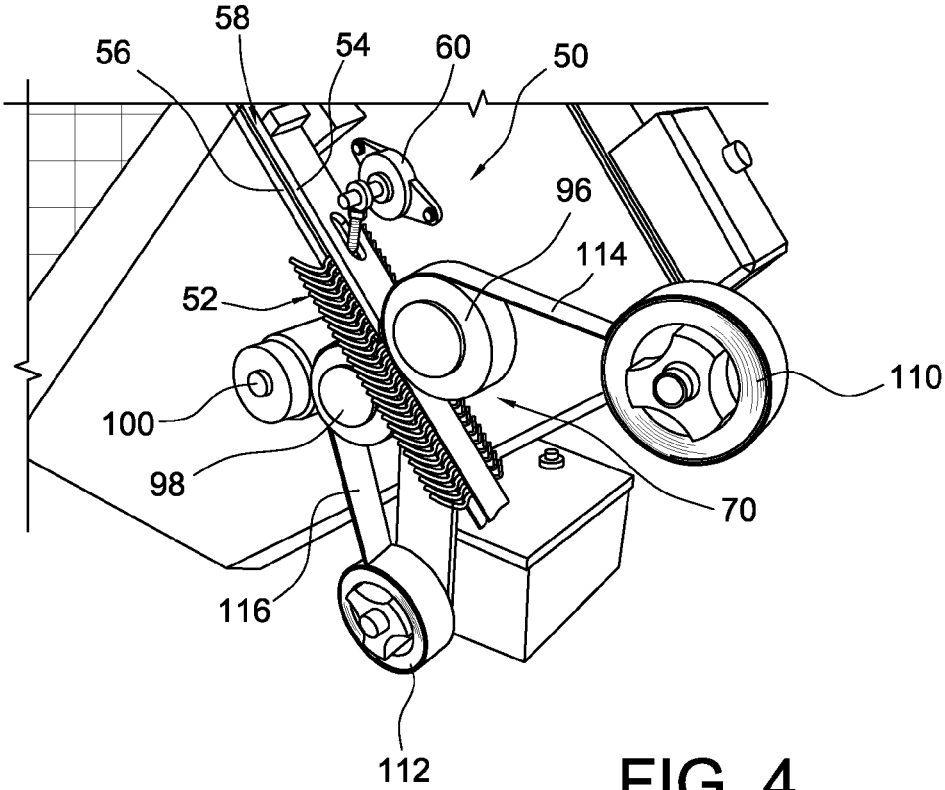
FIG. 4 illustrates in perspective view apparatus for producing the clip bundles of FIG. 3, in accordance with the present invention.
Figure 6:
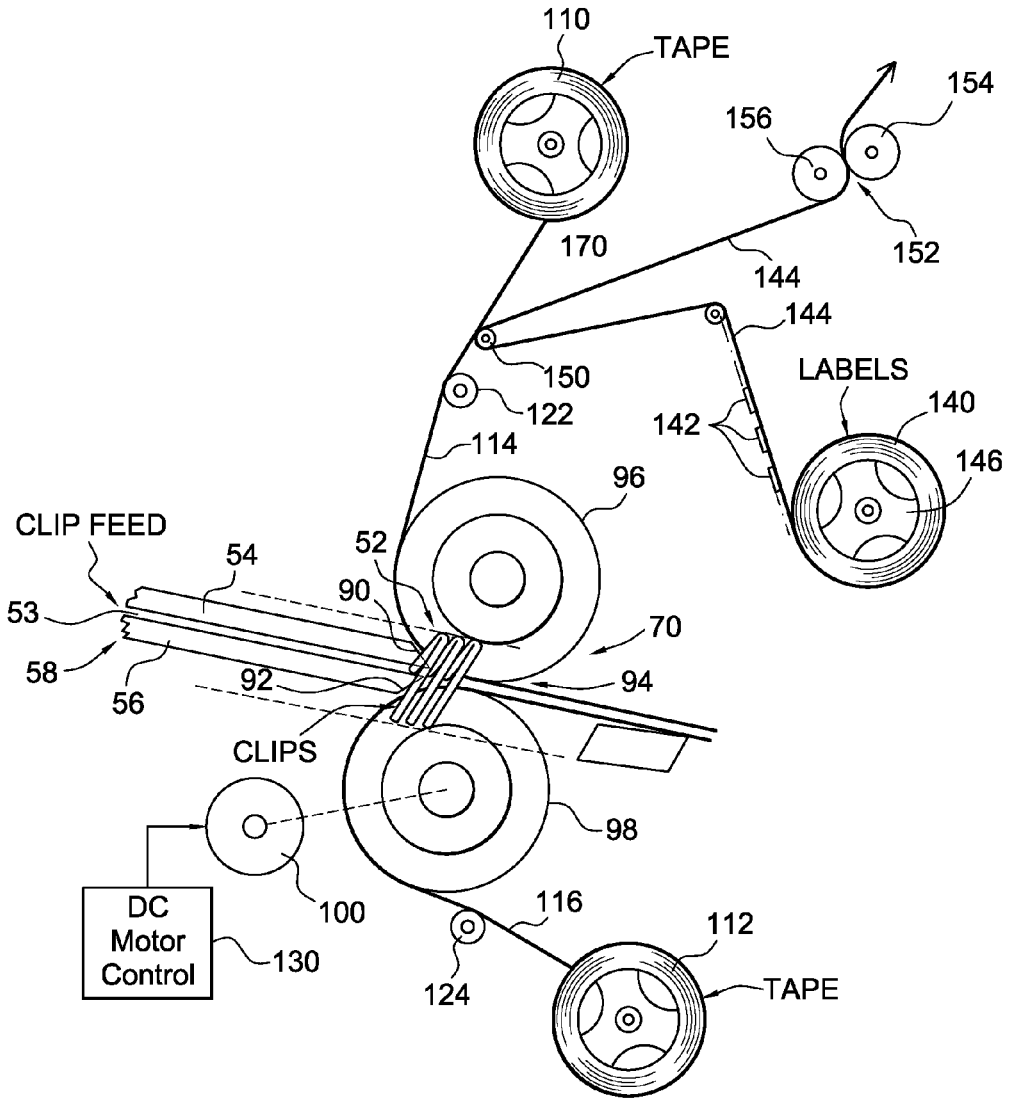
FIG. 6 is a diagrammatic side elevation of the apparatus of FIG. 4, incorporating a label applicator assembly in accordance with a further aspect of the invention.
Figure 7:
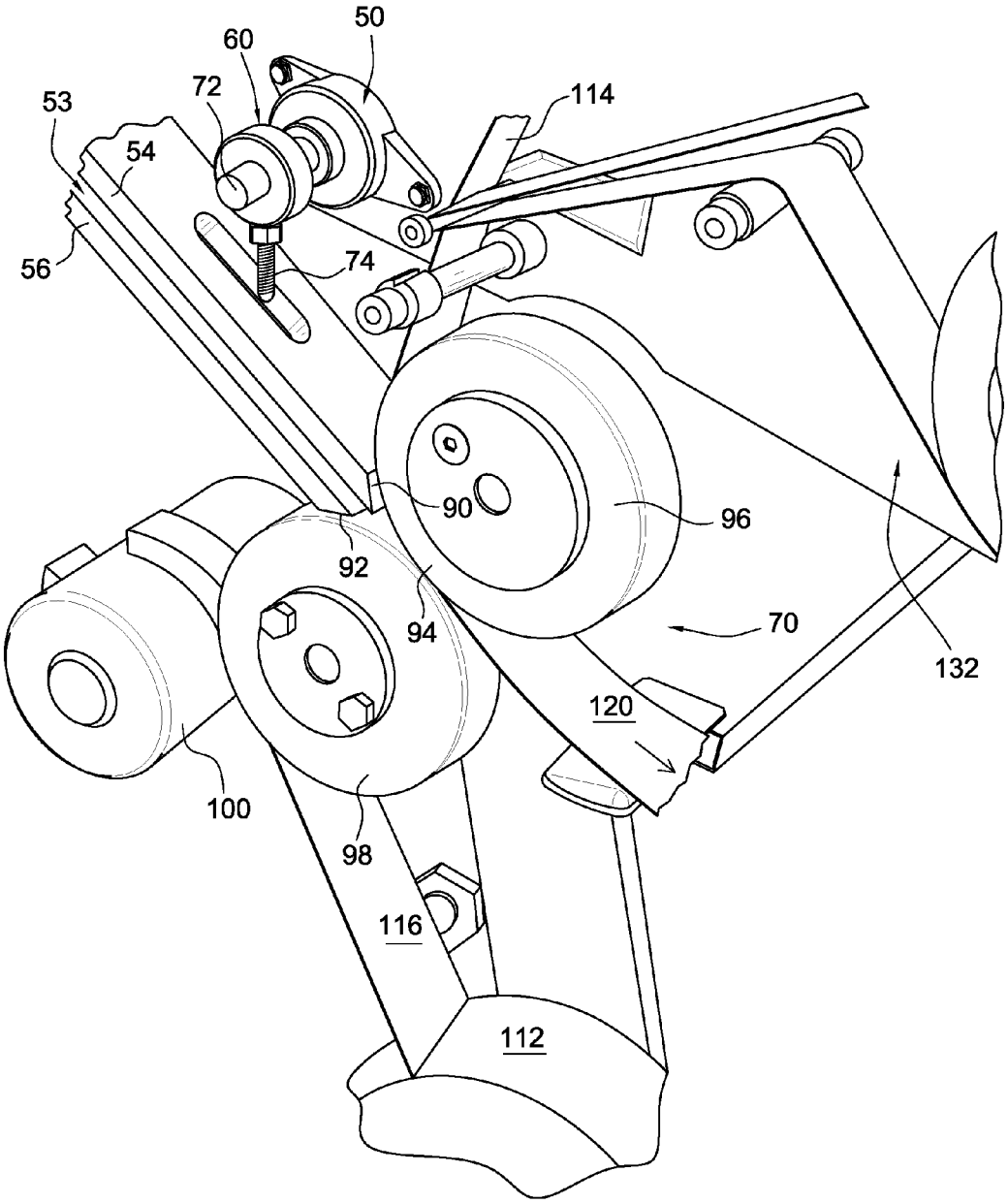
FIG. 7 is an enlarged perspective view of a portion of the apparatus of FIG. 6, illustrating a taping station and a label applicator assembly.
Figure 8:
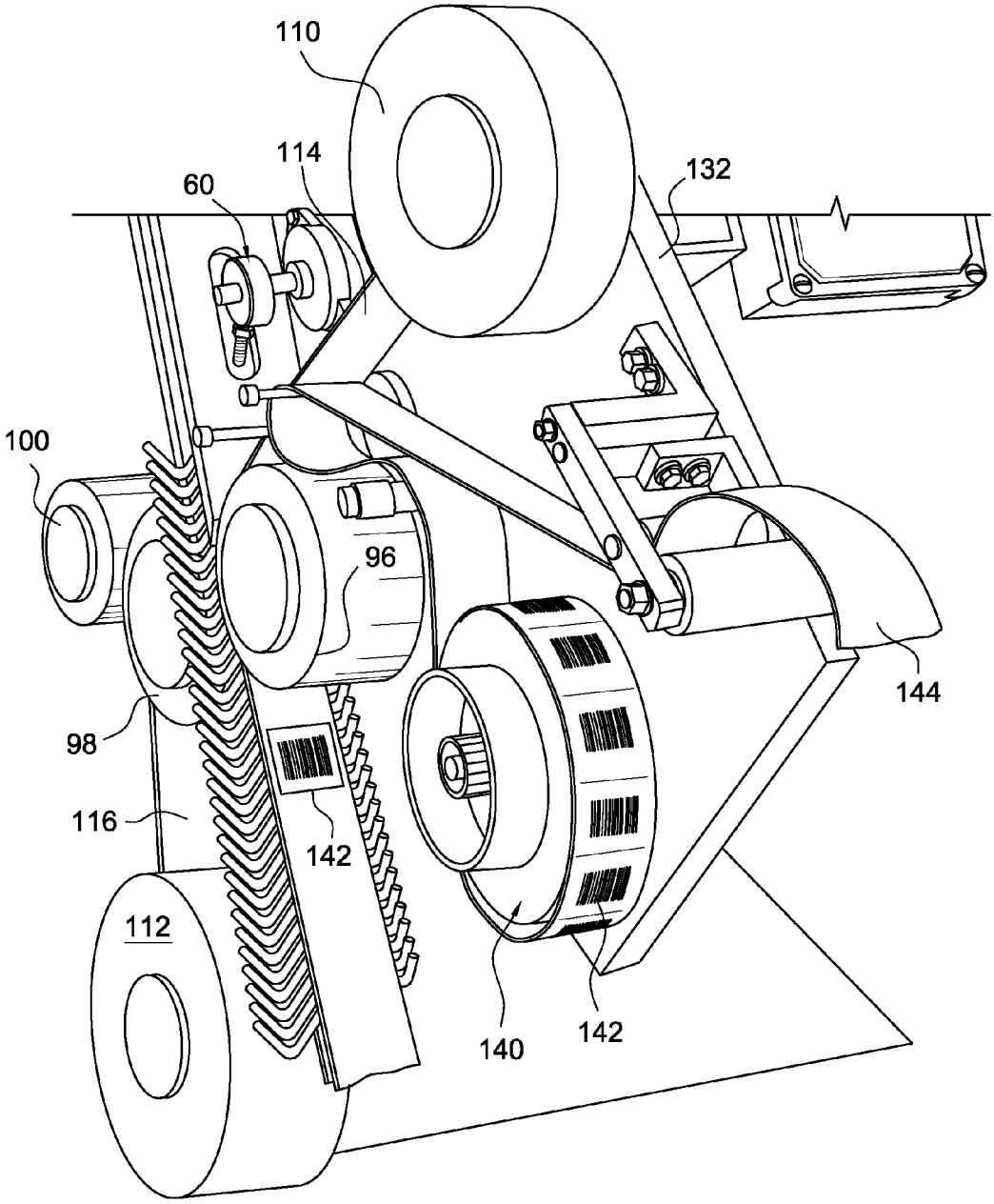
FIG. 8 is another perspective view of the apparatus of FIG. 7, illustrating the formation of a bundle of clips carrying a label, in accordance with the invention.

The bundles 40 are manufactured, in accordance with the present invention, by the method and apparatus illustrated in FIGS. 4-10, wherein similar components are similarly numbered, and to which reference is now made. It is noted that FIG. 4 illustrates the invention without a label-applying mechanism, for simplicity of explanation, while the remaining Figures incorporate the labeling assembly. One aspect of the apparatus for collecting and aligning the fence clips 10 and assembling them into bundles is illustrated, in accordance with an exemplary embodiment of the present invention, at 50 in FIG. 4. As illustrated, a batch 52 of fence clips 10 formed from wire segments, as described above, is placed one at a time in succession into a slot 53 formed between upper and lower parallel spaced planar rail segments 54 and 56 of a feed rail 58, the clips being supplied from a known clip manufacturing machine (not shown) in a continuously running process. Each clip 10 is oriented so that the substantially planar central V-shaped body portion 24 is aligned to be parallel with and slidably inserted between the upper rail segment 54 and the lower rail segment 56 of feed rail 58, which serves as an alignment track for the clips, with the first free end 12 of each clip 10 projecting laterally away from feed rail 58 on one side of the rail and the second free end 14 projecting laterally away from the feed rail on the opposite side of the rail, as best seen in FIGS. 5 and 8. In one example of the apparatus of the present invention, the upper rail segment 54 was preferably 1.730" to 1.750" wide to properly hold the clips.

As the process continues and the clips advance, they slide down rail 58, which has an inclined angle, or slope, which is sufficient to cause the clips to slide reliably down the rail, and may be about 50 degrees from horizontal, to a controllable stop mechanism 60 where the clips are collected into a batch of a selected quantity, the number being dependent on the desired size, or quantity of pins to be included in, a bundle; e.g., 19, 20, 50, or any selected number of clips per group or bundle. As illustrated in the Figures, each clip 10 is sandwiched between, and aligned by, the upper and lower spaced apart flat metal rail segments 54 and 56 of the inclined feed rail 58 to keep the orientation of all of the clips the same while they advance along the rail 58, toward and into a taping station 70. The slot between the upper and lower rail segments defines an alignment track, or path, for the clips, and is preferably between about 0.190" and 0.230" to allow the clips to slide easily while retaining the desired orientation and alignment.

As best seen in FIGS. 4, 5, 7 and 10, the controllable stop mechanism 60 is located above the top rail segment 54 and in one embodiment of the invention may incorporate a rotatable shaft 72 on which is mounted a stop pin 74 positioned to extend through a slot 76 (FIG. 5) in the upper inclined rail segment 54. The stop pin protrudes through the slot and bears against or rests on the bottom rail segment 56 in the path of the advancing clips as they slide down the feed rail 58 to interrupt the flow of the clips and to form a batch of clips that are to be assembled into a bundle at the tape applicator station 70. The shaft 72 is mounted to a suitable activator 80, such as a solenoid or other step motor, which periodically rotates the shaft to move the stop pin 74 upwardly, to withdraw it out of the path of the clips to allow the selected batch of clips to move down the feed rail 58 into the taping station 70. Preferably, the stop pin is biased into its "interrupt" position at rest, and is moved out of the slot upon activation of motor 80.

Figure 11:
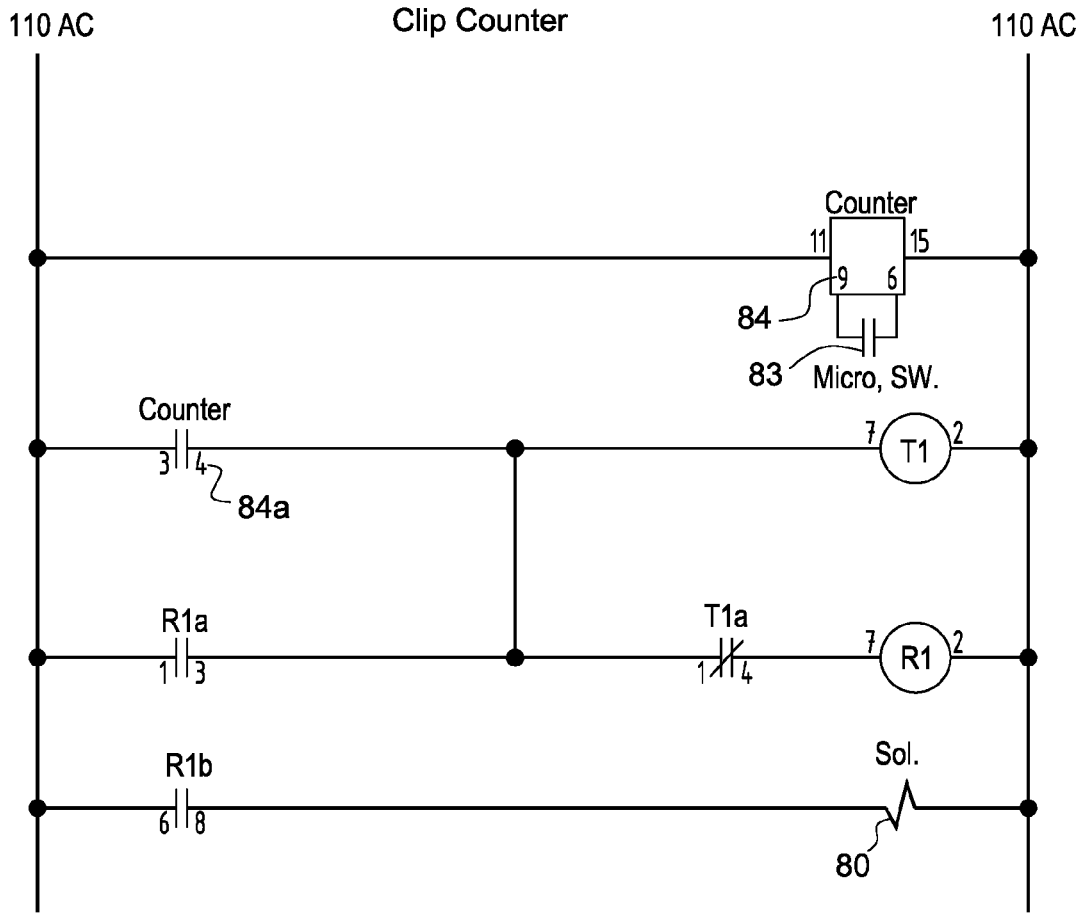
FIG. 11 is a circuit diagram of a fence clip counter and batch controller for use with the apparatus of FIG. 6.

A clip-presence electromagnetic or other suitable proximity sensor 82 (FIGS. 10 and 11) is mounted adjacent the path of the clips 10 as they move down the feed rail 58 to detect the clips as they move toward the location of the stop pin 74. A micro switch 83, that may be attached to a clip manufacturing apparatus (not shown), for example, counts every clip that is supplied to the apparatus of the present invention, as by counting revolutions of a cam which rotates with a feed mechanism to supply the clips. The micro switch is connected to operate a counter 84 which keeps track of the number of clips formed. As illustrated in FIG. 11, sensor 82 activates the counter when clips are present so that the counter can record the number of clips, and when a preset count is reached, as determined by the desired number of clips in a batch, the counter closes a normally-open relay contact 84*a* to energize a relay R1 through a normally-closed relay contact T1*a*. Relay R1 then closes its normally-open contacts R1*a* and R1*b* to energize the solenoid or motor 80 to rotate the stop pin out of the path of the clips, allowing the selected batch to slide down the rail. The counter contact 84*a*, when closed, also energizes timer relay T1, which operates to deactivate the motor 80 after a selected interval by opening normally-closed contact T1*a* to return the stop pin to its interrupt position to start collecting the next batch. The sensor 82 also serves as a fail-safe detector, stopping the process if no clip is detected, or if a malformed clip approaches the batch during a count. In one example of the invention, the sensor was spaced 0.030" to 0.060" from the first free end 12 of each advancing clip 10, where the angle of the right leg was between 50° and 70° so the sensor would reliably detect the clips.

Once the selected quantity of clips 10 has been collected at the stop pin, and the stop pin motor 80 has been actuated and the stop pin 74 withdrawn, the clips slide down the alignment path into the taping station 70. The top and bottom rails 54 and 56 of the inclined feed rail 58 terminate distally in chamfered edges 90 and 92, respectively, at the taping station. The rail's chamfered edges are closely adjacent a nip 94 (FIG. 7) formed between upper and lower tape applicator pressure rollers 96 and 98 to feed the batch of clips into the nip when the clips are released by the stop pin 74. One of these rollers, for example roller 98, is driven by a suitable drive motor 100, while the other, for example roller 96, is mounted on a shaft to serve as an idler that driven by roller 98 by contact at the nip 94. Upper and lower rolls 110 and 112 of flexible adhesive-bearing substrates 114 and 116, respectively, which may be, for example, 1½ inch wide masking tape having an adhesive coating on one side. The rolls supply strips of tape to the respective upper and lower rollers 96 and 98 and into the nip 94 with the non-adhesive sides of the strips of tape in contact with the roller surfaces. Rotation of the motor causes the drive roller 98 to draw strip 116 into and through the nip 94, and the contact at the nip causes idler roller 96 also to rotate to draw strip 114 into the nip. As illustrated in FIG. 7, such rotation causes the adhesive sides of strips 114 and 116 to engage each other at the nip and to adhere together, in the absence of a batch of fencing clips, to produce double strip 120 at the outlet of the nip.

In operation, when the drive roller motor 100 is activated and the stop pin releases a batch of clips, the clips are fed by gravity into the nip where the rotating rollers draw them into and through the nip between the two strips 114 and 116, as illustrated in FIGS. 4, 6 and 8. As the clips pass into and through the nip, the tape strips are applied under pressure to the tops and to the bottoms of the flat middle portions 24 of the clips, securing the adjacent clips in a batch together to form a bundle such as that described above and illustrated in FIG. 3. Preferably, each strip of masking tape travels around a tension roller before being applied to the clips, as illustrated by tension rollers 122 and 124 for strips 114 and 116, respectively, to maintain a constant tension on the tape and to help position the tape in the middle of the clips.

After the selected quantity clips in a batch has been sensed and the counter has activated the motor or solenoid 80 that releases the stop pin 74 to allow the clips to slide into the taping area, the timer in the counter 84; for example, the timer relay T1, keeps the stop pin open for a preset time to allow the batch containing the desired quantity of clips to pass into the nip. The timer then releases the stop pin, allowing it to return to the interrupt position for a period of time while the drive motor 100 continues to rotate rollers 96 and 98, drawing the batch of clips through the nip to eject a completed bundle from the taping station and continuing to run for a period of time before releasing the next batch of clips. The release of sequential batches of clips is timed to form about a 5 inch gap of doubled masking tape to be formed between each successive batch of clips to produce an intermediate section of double tape which can be severed to produce individual bundles of taped clips containing selected numbers of clips that can then be packaged, as by placing them in boxes sized to match the length of a strip of clips. As described above, the sensor 82 attached to the inclined rail 58 above the stop pin not only counts the desired number of clips to be accumulated in a batch, but also serves as an automatic shut off. If a clip does not pass by the automatic shutoff within a preset time of, for example, two seconds, it shuts off the clip manufacturing machine that is supplying clips to the feed rail 58. Thus, if the machine makes a bad clip, the clip will not slide down the inclined rail and this will activate the automatic shut off. This keeps the machine from continuing to make bad clips and jamming.

The speed of the adhesive tape strips, as the upper tape strip 114 and the lower tape strip 16 are applied, is controlled by a DC speed controller 130 to synchronize the tape speed to the speed of the machine producing the clips that are supplied to the feed rail 58. The speed controller is illustrated diagrammatically in FIG. 6, and is also illustrated in the exemplary embodiment of FIG. 9, where it is shown as being mounted on a support panel 132. In this example, the various components described above are also mounted on this panel, but on the opposite side thereof. It will be understood that this assemblage was for the purposes of producing a working model of the invention and may be modified.

Figure 9:
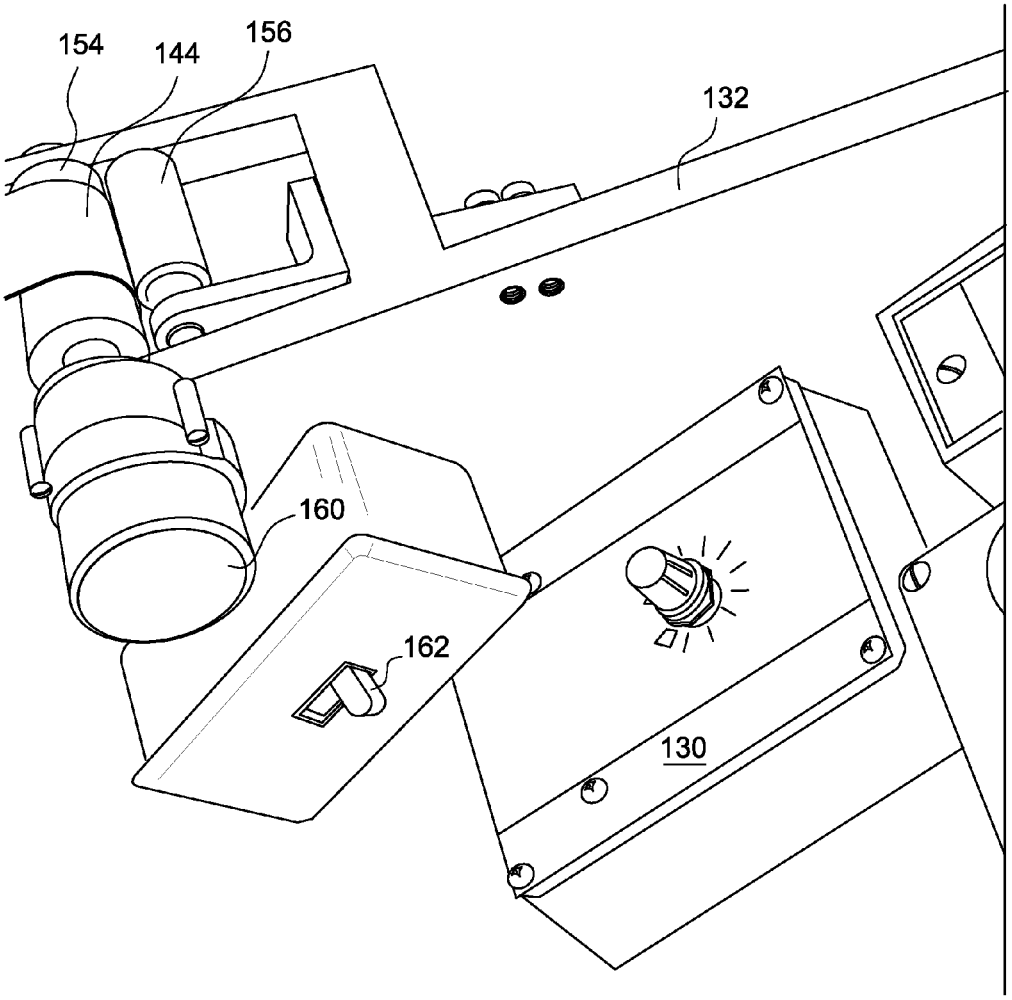
FIG. 9 illustrates a control assembly for the apparatus of FIG. 6.

In accordance with another aspect of the invention, labels incorporating bar codes, logos, or other indicia are applied to the clip bundles as they are being formed at the taping station 70. This is accomplished by the addition of a supply roll 140 of adhesive labels 142 that are releasably secured side-by-side along a thin, flexible substrate 144. Roll 140 is mounted for rotation on a hub 146 that may be mounted on the panel 132, and the substrate is fed from the roll around a release post 150 and through a nip 152 between a pair of feed rollers including a drive roller 154 and an idler 156. As illustrated in FIG. 9, feed roller 154 is driven by a motor 160 that may be controlled by a suitable control that may include an on/off switch 162 mounted on panel 132. The hub 146 is braked sufficiently to produce tension in label substrate 144 when the motor 160 is turned on and the rollers 154 and 156 draw the substrate off the roll 140.

In the illustrated configuration, which exemplifies of the apparatus of the invention, the release post 150 is positioned on the path of the masking tape strip 114, as illustrated in FIG. 6, so that both the non-adhesive side of strip 114 and the label side of substrate 144 are in contact with each other as they pass in opposite directions around the post. As the substrate 144 is drawn along its path under tension, it passes around the release post 150 at an acute angle 170, which may be between about 10 and 20 degrees, the tension and the angle being adjusted to cause each of the labels 142 to be released from substrate 144 as the substrate passes around the release post and the label tape and the masking tape strip are coming into contact with each other. This causes the adhesive side of a partially released label 142 to engage the surface of the tape and to adhere to it, causing the label to transfer to the non-adhesive side of strip 114. The label is the carried by the strip 114 into the nip 94 on the strip 114, and is thereby applied to the bundle of clips being formed there, as illustrated in FIG. 8. Each time a bundle is to be formed, therefore, a label is applied to the strip 114, either automatically, as timed by the stop pin release, or manually by manipulation of switch 162. It will be understood that although the labels are illustrated as being transferred to the upper strip 114, the label applicator assembly could equally well be positioned to apply the labels to the lower strip 116.

Persons having skill in the art will appreciate that the system and method of the present invention as described and illustrated herein economically packages wire fence clips 10 into compact, safe, easy to handle bundles 40 by collecting and aligning the fence clips into batches of selected quantity and then affixing first and second flexible adhesive substrates, such as upper and lower masking tape strips, onto the top and bottom surfaces of the collected batches of clips to form aligned bundles. In addition, labels bearing indicia such as bar codes or logos are applied to one of the masking tape strips before the bundles are formed to provide suitable identification for the bundles. The product of this process is a compact and easy to carry bundle of a selected quantity of fencing clips incorporating indicia-bearing labels. Each bundle is safe to carry and use, due to the fact that the first and second free ends of each clip are aligned and adjacent each other, and therefore not individually projecting outwardly in a dangerous tangle which is likely to injure a user or fence installer.

Having described preferred embodiments of a new and improved method, it is believed that other modifications, variations and changes will be suggested to those skilled in the art in view of the teachings set forth herein. It is therefore to be understood that all such variations, modifications and changes are believed to fall within the scope of the present invention, as set forth in the accompanying claims.

What is claimed is:

1. An automated method for packaging wire fence clips in compact, safe, easy to handle bundles, comprising:

(a) providing an alignment track having upper and lower parallel spaced planar rail segments defining a path for receiving and orienting fence clips to be packaged in a bundle, said fence clips having central body portions that are slidably insertable between said upper and lower segments of said track with their free ends projecting laterally away from the track on opposite sides of the track;

(b) providing a movable stop pin in said path to engage and collect a batch of a selected quantity of said fence clips;

(c) providing a taping station at a terminal end of said alignment track said taping station including pressure rollers defining a nip aligned with said alignment track path;

(d) providing upper and lower upper and lower supply rolls respectively located above and below said alignment track;

(e) providing upper and lower strips of a flexible adhesive-bearing substrate supplied along corresponding supply paths form respective upper and lower supply rolls to engage said upper and lower pressure rollers, respectively, at said nip;

(f) providing a stop pin release for feeding said fence clips into said nip between said upper and lower substrate strips form a bundle of fence clips in said taping station;

(g) collecting and aligning fence clips on said alignment track into a series of batches that each incorporate said selected quantity of said fence clips;

(h) feeding each batch of clips through said taping station;

(i) supplying said first and second flexible adhesive substrate strips to said taping station;

(j) affixing said first and second substrate strips to top and bottom sides of the batch as it passes through the taping station to secure the clips of a batch together to form a bundle; and (k) separating successive bundles, whereby compact and easy to carry bundles each having a selected quantity of fence clips is formed.

2. The method of claim 1, further including:

(l) applying at least one label to one of said substrates prior to supplying the substrate to the taping station.

3. The method of claim 1, wherein said stop pin release provided in method step (f) includes a counter for actuating said stop pin when a selected quantity of fencing clips has collected in a batch at said stop pin to withdraw the stop pin to feed the fencing clips to the taping station, and the method further comprises:

(m) restoring said stop pin into said path after a predetermined interval corresponding to said selected quantity has passed to collect a next succeeding batch and to provide a gap between successive bundles as they exit from the taping station.

4. The method of claim 3, wherein said method step (e) further comprises:

(e1) providing upper and lower tension rollers adjacent said upper and lower supply paths, respectively; and (e2) aligning said upper and lower strips of flexible adhesive-bearing substrate supplied from respective upper and lower supply rolls traveling along corresponding upper and lower paths and over corresponding tension rollers before being supplied to said upper and lower pressure rollers to maintain a constant tension on the strips to help position the strips on the central body portions of fencing clips in said batches.

5. An automated method for packaging wire fence clips in compact, safe, easy to handle bundles, comprising:

(a) providing an alignment track having upper and lower parallel spaced planar rail segments defining a path for receiving and orienting fence clips to be packaged in a bundle, said fence clips having central body portions that are slidably insertable between said upper and lower segments of said track with their free ends projecting laterally away from the track on opposite sides of the track;

(b) providing a movable stop pin in said path to engage and collect a batch of a selected quantity of said fence clips;

(c) providing a taping station at a terminal end of said alignment track, said taping station including upper and lower pressure rollers defining a nip aligned with said alignment track path;

(d) providing upper and lower supply rolls respectively located above and below said alignment track;

(e) providing upper and lower tension rollers adjacent said upper and lower supply paths, respectively, and aligning upper and lower strips of a flexible adhesive-bearing substrate supplied along corresponding supply paths from respective upper and lower supply rolls to engage said upper and lower pressure rollers, respectively, at said nip; and applying tension to said upper and lower strips of flexible adhesive-bearing substrate supplied from respective upper and lower supply rolls with said upper and lower pressure rollers to maintain a constant tension on the strips to help position the strips on the central body portions of fencing clips in said batch;

(f) providing a stop pin release mechanism for feeding said fence clips into said nip between said upper and lower substrate strips form a bundle of fence clips in said taping station; said stop pin release mechanism also including a counter for actuating said stop pin when a selected quantity of fencing clips has collected in a batch at said stop pin to withdraw the stop pin to feed the fencing clips to the taping station;

(g) collecting and aligning fence clips on said alignment track into a first batch for a series of batches that each incorporate said selected quantity of said fence clips;

(h) feeding the first batch of clips through said taping station;

(i) supplying said first and second flexible adhesive substrate strips to said taping station;

(j) affixing said first and second substrate strips to top and bottom sides of the first batch as it passes through the taping station to secure the clips of the first batch together to form a first bundle; and (k) separating the first bundle from successive bundles, whereby compact and easy to carry bundles each having a selected quantity of fence clips is formed.

6. The method of claim 5, further including:

(l) applying at least one label to one of said substrates prior to supplying the substrate to the taping station;

(m) restoring said stop pin into said path after a predetermined interval corresponding to said selected quantity has passed to collect a next succeeding batch and to provide a gap between successive bundles as they exit from the taping station.

7. The method of claim 5, further including:

(n) providing an electronic automatic shutoff sensor to detect whether a fence clips pass by the automatic shutoff within a preset operating time; and (o) shutting off the taping station if said preset operating time is exceeded.

* * * * *